United States Patent [19]

Siegle

[11] 3,956,657

[45] May 11, 1976

[54] PRE-IGNITION GAP

[75] Inventor: Gert Siegle, Renningen, Germany

[73] Assignee: Robert Bosch G.m.b.H., Stuttgart, Germany

[22] Filed: Jan. 27, 1975

[21] Appl. No.: 544,825

Related U.S. Application Data

[63] Continuation of Ser. No. 379,108, July 13, 1973, abandoned.

[30] Foreign Application Priority Data

July 18, 1972 Germany ..... 2235117

[52] U.S. Cl. ..... 313/214; 313/124; 313/182; 313/311

[51] Int. Cl.[2] ..... A47B 81/00

[58] Field of Search ..... 313/118, 124, 182, 184, 313/214, 311

[56] References Cited

UNITED STATES PATENTS

| | | | |
|---|---|---|---|
| 2,449,967 | 9/1948 | Jones | 313/214 X |
| 3,742,280 | 6/1973 | Siegle | 313/124 X |
| 3,761,761 | 9/1973 | Van Oostrum | 313/311 |

*Primary Examiner*—R. V. Rolinec
*Assistant Examiner*—Lawrence J. Dahl
*Attorney, Agent, or Firm*—Michael J. Striker

[57] ABSTRACT

A pre-ignition gap for coil ignition systems consists of a pair of electrodes which extend into a closed compartment. Each electrode has a free end within the compartment and the free ends of the electrodes are juxtaposed with and spaced from one another. A body of inert gas in the compartment surrounds the free ends of the electrodes. In the region of sparking, the electrodes are composed, at least in part, of a substance selected from the group consisting of aluminum and the transition metals of the fourth, fifth and sixth groups of the periodic system.

12 Claims, 1 Drawing Figure

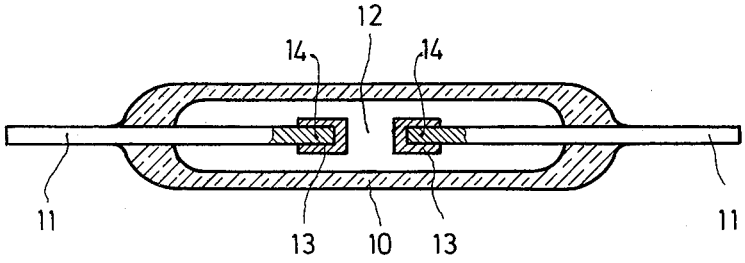
12
14
14
11
13
10
13
11

PRE-IGNITION GAP

This is a continuation of application Ser. No. 379,108, filed July 13, 1973, now abandoned.

BACKGROUND OF THE INVENTION

The invention relates generally to ignition systems. More particularly, the invention relates to ignition systems for combustion engines, especially coil ignition systems. The ignition systems of special interest are those of the type having pre-ignition gaps connected in series in the high-tension lines thereof.

In the conventional ignition systems, without pre-ignition gaps, the spark plug voltage builds up relatively slowly until a potential difference, i.e., voltage, equal to the sparking voltage is set up between the electrodes of the spark plugs. At this time, a spark is generated between the electrodes of the spark plugs, i.e., across the spark plug gap. Normally, the spark plugs are provided with a ceramic jacket which serves as an insulator. When that portion of the ceramic jacket adjacent the electrodes of the spark plug becomes coated with a layer of carbon black and/or lead residues, or if this portion of the ceramic jacket is wet or coated with oil, then part of the charge or energy delivered to the spark plug by the coil of the ignition system flows off along the coating on the ceramic jacket. The charge flowing along this coating does not participate in setting up a potential difference between the electrodes of the spark plug so that this charge is effectively wasted. When the coating on the ceramic jacket becomes sufficiently heavy, so much of the charge delivered to the spark plug leaks away, i.e., flows off, that the voltage between the electrodes required for generating a spark can no longer be attained.

This susceptibility to leakage of the ignition systems for combustion engines may, in known manner, be greatly reduced by connecting pre-ignition gaps in series in the high-tension leads of the ignition system. A pre-ignition gap for this purpose may be connected in the circuit immediately upstream of the spark plug or may be built into the spark plug itself. In order to serve its purpose, the pre-ignition gap should have a breakdown voltage, i.e., voltage at which sparking occurs therein, which is greater than that of the spark plug. Since the pre-ignition gap is located upstream of the spark plug, i.e., upstream of the spark plug gap, no sparking across the spark plug gap can occur until sparking has first occurred across the pre-ignition gap, that is, the generation of a spark across the pre-ignition gap "completes" the circuit to the spark plug. Thus, since the sparking voltage of the pre-ignition gap is greater than that of the spark plug, a relatively high voltage will exist across the spark plug gap at least at the instant that sparking occurs across the pre-ignition gap. As a result, a spark will be generated across the spark plug gap even though the ceramic insulating jacket of the spark plug may be coated with a layer of dirt. The reason is that the leakage of charge along the coating on the ceramic jacket of the spark plug is negligibly small compared to the high voltage which rapidly comes into being across the spark plug gap at the instant that sparking occurs across the pre-ignition gap. In other words, when sparking occurs across the pre-ignition gap, the voltage across the spark plug gap builds up almost instantaneously so that practially no time exists for leakage of charge to occur. This is in contrast to ignition systems without pre-ignition gaps where the voltage across the spark plug gap builds up slowly so that ample time exists for charge to leak away.

There has been much research directed to the problem of producing suitable pre-ignition gaps for connection into ignition systems of both the type which may be built into the bore of the spark plug insulation and the type which may be in the form of separate elements located in a plug connector which is then plugged into the spark plug. The focus has been on providing pre-ignition gaps which are suitable for the ignition systems currently used in combustion engines and which will insure ignition even for lean fuel-air mixtures. Some current pre-ignition gaps are disclosed, for example, in the U.S. Pat. Nos. 2,505,150 and 2,965,779. The known pre-ignition gaps are, however, very expensive because the cost of producing electrodes which are low in sputtering is high and, in addition, the known electrodes impose strict requirements as regards the purity of the gas surrounding them in the region of sparking. One of the reasons that the known electrodes are high in cost is that, until now, these were provided with coverings or coatings consisting of oxinitrides or nitrides. The production of such oxinitrides and nitrides and the processes involved in coating the electrodes with them require additional and expensive production steps. Furthermore, the known pre-ignition gaps are not fully satisfactory with respect to the stability of their sparking voltage and with respect to their frequency dependence. Thus, in the known pre-ignition gaps, the sparking voltage fluctuates over a wide range. If the sparking voltage of the pre-ignition gap is too high, then it may exceed the voltage which can be supplied by the ignition system with the result that no sparking whatsoever will occur (even with new spark plugs). On the other hand, if the sparking voltage of the pre-ignition gap is too low, the pre-ignition gap loses its effectiveness since sparking across it will occur at a relatively low voltage. The result of this is that, at the instant that sparking occurs across the pre-ignition gap, the voltage across the spark plug gap will also be relatively low so that the loss of charge along the coating on the ceramic jacket of the spark plug becomes significant again and no sparking will occur across the spark plug gap. Insofar as the frequency dependence of the pre-ignition gap is concerned, the sparking voltage of the known pre-ignition gaps falls off greatly at higher frequencies so that, again, the pre-ignition gap loses its effectiveness.

SUMMARY OF THE INVENTION

It is, accordingly, an object of the invention to provide a novel ignition system.

More particularly, it is an object of the invention to provide an ignition system, especially a coil ignition system, having pre-ignition gaps connected in its high-tension leads and wherein the pre-ignition gaps are much cheaper to produce than has been possible heretofore.

Another object of the invention is to provide an ignition system, especially a coil ignition system, having pre-ignition gaps connected in its high-tension leads and wherein the pre-ignition gaps may either be built into the bores of the spark plug insulation or be in the form of separate elements located in plug connectors which are then plugged into the spark plugs.

A further object of the invention is to provide an ignition system, especially a coil ignition system, having pre-ignition gaps connected in its high-tension leads and wherein the frequency dependence of the pre-ignition gaps is low.

An additional object of the invention is to provide an ignition system, especially a coil ignition system, having pre-ignition gaps connected in its high-tension leads and wherein the average value of the sparking voltage of the pre-ignition gaps is relatively stable for the life of the spark plugs or the plug connectors.

In accordance with these and other objects which will become apparent, the invention provides, in an ignition system for combustion engines, particularly a coil ignition system, a pre-ignition gap which comprises means defining a closed compartment, and a pair of electrodes extending into the compartment and having juxtaposed free ends therein which are spaced from one another. In the region of sparking, the electrodes comprise at least one substance selected from the group consisting of aluminum and the transition metals of the fourth, fifth and sixth groups of the periodic system. A body of inert gas is accommodated in the compartment and surrounds the free ends of the electrodes.

Since the electrodes of the invention comprise metals in the region of sparking, rather than oxides or nitrides, the electrodes may be manufactured using simple and cheap production processes. Thus, the pre-ignition gap of the invention is extremely inexpensive to produce as an article in bulk. Furthermore, the frequency dependence of the novel pre-ignition gap is low and the sparking voltage varies only very little until frequencies of at least 150 Hertz.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The single FIGURE is an enlarged schematic longitudinal cross section through a pre-ignition gap according to the invention.

DESCRIPTION OF THE PREFERRED EMBODIMENTS

With reference to the single FIGURE, which is a schematic longitudinal cross section through a pre-ignition gap according to the invention, means for defining a closed compartment is here shown as being in the form of an elongated tube 10. The tube 10 defines a closed compartment 12 and a pair of electrodes 11 extends into the compartment 12. The electrodes 11 have juxtaposed free ends 14 in the compartment 12 and the free ends 14 of the electrodes 11 are spaced from one another. A body of gas is accommodated within the compartment 12 and surrounds the free ends 14 of the electrodes 11.

Before proceeding to a more comprehensive discussion of the novel pre-ignition gap, it is pointed out that the novel pre-ignition gap may be used in ignition systems for combustion engines and is particularly adaptable for use in coil ignition systems. When utilized in such ignition systems, the pre-ignition gap is connected into the high-tension lines or leads of the ignition systems. Where an ignition system includes more than one spark plug, a distributor is normally used and a separate line leads from the distributor to each of the spark plugs. A pre-ignition gap may then be connected into each of these lines. The pre-ignition gap may be inserted into the respective line anywhere between the distributor and the spark gap of the spark plug. It is preferred, however, in accordance with the invention, that the pre-ignition gap is built into a spark plug connector or into the longitudinal bore of the insulation for the spark plug. The novel pre-ignition gap may have a sparking voltage or average sparking voltage between substantially 2 and 16 kV and, advantageously, between 4 and 12 kV.

Referring again to the FIGURE, it is now noted that the tube 10 may be designed in such a manner that it can be built into a spark plug connector or into the longitudinal bore of the insulation for a spark plug. It is favorable when the tube 10 is composed of an insulating material, and examples of such a material are glass, aluminum oxide, beryllium oxide and zirconium oxide. Exemplary dimensions for the tube 10, which are to be considered as only exemplary and not limiting in any manner, may be as follows: length, 25 mm.; outer diameter, 4.5 mm.; inner diameter, 3.2 mm.

The electrodes 11 extend into the tube 10 from opposite ends of the latter. That portion of each of the electrodes 11 located exteriorly of the tube 10 may serve for forming electrical connections so as to electrically integrate the pre-ignition gap into the electrical circuit of the ignition system. The tube 10 and electrodes 11 may be fused to one another in the regions where the latter extend into the tube 10. Both the tube 10 and the electrodes 11 may be fused in these regions or only one of the two may be fused in these regions.

The compartment 12 in which the free ends 14 of the electrodes 11 are located defines a discharge space and sparking occurs between the free ends 14 of the electrodes 11. In the region of sparking, i.e., in the region of the free ends 14, the electrodes comprise at least one substance which is selected from the group of elements A1 and the transition elements of Groups IV, V and VI of the periodic system. The transition elements of the fourth, fifth and sixth groups of the periodic system include the metals titanium, zirconium, hafnium, vanadium, niobium (columbium), tantalum, chromium, molybdenum and tungsten (wolfram). It is irrevelant whether the free ends 14 of the electrodes 11 comprise a single one of these elements or whether the free ends 14 of the electrodes 11 comprise mixtures or alloys of these elements. Furthermore, if the free ends 14 of the electrodes 11 comprise an alloy or mixture of these elements, the proportions in which the various elements are combined with one another is also irrevelant. In addition, as many of these elements as desired may be combined into an alloy or mixture for use in the pre-ignition gap. It is further pointed out that the two free ends 14 of the electrodes 11 may have different compositions. For example, one of the electrodes 11 may have a free end 14 comprising hafnium whereas the other electrode 11 may have a free end 14 comprising vanadium. The same holds true if the free ends 14 of the electrodes 11 comprise alloys of the elements identified above. When the free ends 14 of the electrodes 11 comprise the above-identified elements or combinations thereof, the electrodes 11 are low in sputtering.

According to one embodiment of the invention, the elements or metals mentioned earlier are provided on the electrodes 11 in the form of a coating 13. This may be seen from the FIGURE where the free ends 14 of the electrodes 11 are illustrated as being provided with cup-shaped coatings 13, for example, of zirconium, in the region of sparking. In this illustration, the coatings 13 have been pressed onto the free ends 14 of the electrodes 11. However, the coatings 13 may be applied to the free ends 14 of the electrodes 11 by any known method, examples of such methods being plasma spraying, fusion welding, spot welding, gaseous phase deposition, galvanic deposition, cold plastic deformation and clamping. Also, although the coatings 13 on the free ends 14 of the electrodes 11 are shown as being cup-shaped, they may equally well be in the form of a pin-head or nail-head. If the inner diameter of the discharge space or compartment 12 is sufficiently large, the coatings 13 may, however, be plate-shaped or pot-shaped. Of the group of elements identified above, the most suitable for use in forming the coatings 13 on the free ends 14 of the electrodes 11 are zirconium and hafnium. Coatings 13 composed essentially of zirconium are particularly economical to produce and electrodes 11 provided with such coatings 13 in the region of sparking permit an especially economical pre-ignition gap to be manufactured. It is mentioned here that the coatings 13 for use in the region of sparking may be made from the nitrides of titanium, zirconium and hafnium but, as pointed out previously, the pre-ignition gap may be made more cheaply when one of the group of elements outlined earlier, or combinations of these elements, rather than chemical compounds, are used for forming the coatings 13. As an example, it is not only considerably cheaper to provide the free ends 14 of the electrodes 11 with a coating 13 of zirconium than to apply a nitride coating, which serves the same purpose, thereto, but it is also much simpler and, in addition, such a zirconium coating 13 is low in sputtering.

In the embodiment being presently discussed, that is, the embodiment wherein the free ends 14 of the electrodes 11 are provided with a coating 13, the electrodes 11 are favorably composed of an electrically conducting material the coefficient of thermal expansion of which is substantially equal to that of the tube 10. In other words, the electrodes 11 are favorably composed of an electrically conducting material having a coefficient of thermal expansion substantially corresponding to that of the material of which the tube 10 is composed. Preferred materials for the electrodes 11 include iron-cobalt-nickel alloys and iron-cobalt-chromium alloys. Other suitable materials for this purpose include steels having the following alloying components, for example: (a) 51% Ni, 0.9% Cr; (b) 46% Ni, 5.5% Cr; (c) 48% Ni, 6% Mo; (d) 29% Ni, 17% Co. In addition, tungsten, tantalum and molybdenum may also be used for the electrodes 11.

According to another advantageous embodiment of the invention, there is no need for the electrodes 11 to be provided with a coating 13 at the free ends 14 thereof. Thus, it is possible for the electrodes 11 to be composed of tantalum, for example, and for the tantalum electrodes 11 to be fused directly to the tube 10 in the manner outlined earlier. In such an instance, the electrodes 11 do not have to be made from a special electrically conducting material. The tantalum here serves a dual purpose, that is, it serves as an electrical conductor and in lieu of the coating 13. Among other materials which may be used instead of tantalum are tungsten and molybdenum. It is assumed, of course, that the coefficient of thermal expansion of the tantalum, tungsten or molybdenum, as the case may be, corresponds substantially to that of the tube 10.

In accordance with the invention, the spacing between the juxtaposed free ends 14 of the electrodes 11 in the region of sparking or, where the free ends 14 of the electrodes 11 are provided with coatings 13, the spacing between the coatings 13 on the respective free ends 14 of the electrodes 11, should be in the range of 0.5 to 5 mm. Preferably, this spacing is between 0.8 and 2.5 mm. A representative but non-limiting spacing may, for example, be 0.9 mm. The inner diameter of the compartment 12 should be at least twice as large as the spacing between the free ends 14 of the electrodes 11, or the spacing between the coatings 13 provided thereon, and, advantageously, the inner diameter of the compartment 12 is between three and six times as large as this spacing.

As already mentioned, a body of gas such as, for example, an inert gas, is accommodated in the compartment 12 and surrounds the free ends 14 of the electrodes 11. Favorably, the gas in the compartment 12 is argon. However, other gases may also be used instead of argon, examples being neon and krypton. Although other gases may be used instead of argon, such gases are usually more expensive than argon. Additions of up to 10% by weight of hydrogen and up to 0.1% by weight of oxygen and/or water to the gas in the compartment 12 are not harmful to the operation of the pre-ignition gap. There are no requirements imposed on the gas for use in the novel pre-ignition gap beyond those imposed on commercially available gases. The reason is that the lattice effect of the electrodes 11 in the pre-ignition gap binds the reactive gases which may be present, during the initial operating period of the pre-ignition gap. Thus, the electrodes 11 according to the invention have the property that they are able to form stable compounds with oxygen, hydrogen and nitrogen. This property is not exhibited by electrodes which are composed of oxides or nitrides or which are provided with coatings of such materials, at least not to the extent exhibited by electrodes in accordance with the invention. Since oxygen, hydrogen and nitrogen constitute the major portion of the possible impurities which are to be found in the gases used in pre-ignition gaps, the lattice effect of the electrodes 11 of the invention maintains a high degree of purity in the compartment 12.

In pre-ignition gaps according to the invention, the pressure of the gas in the compartment 12 has a predetermined value in the range of 0.8 to 10 bars. Preferably, the pressure of the gas in the compartment 12 lies between 2 and 7 bars. As a representative but non-limiting value, the pressure of the gas in the compartment 12 may be 3 bars, for example.

It is particularly advantageous, in accordance with the invention, when the pre-ignition gap combines the features discussed above, that is, when the pre-ignition gap possesses a combination of the following characteristics.

a. The electrodes comprise, in the region of sparking, at least one substance selected from the group consisting of aluminum and the transition metals of the fourth, fifth and sixth groups of the periodic system. It is emphasized here that these substances may be alloyed or combined in any proportions and that the two electrodes of the pre-ignition gap may comprise different compositions or substances.

b. The body of gas in the discharge space comprises at least one noble or inert gas and at most 10% by weight of hydrogen and no more than 0.1% by weight of oxygen and/or water.

c. The gas in the discharge space is at a pressure between 0.8 and 10 bars and, preferably, between 2 and 7 bars. Argon is particularly suitable for use as a noble or inert gas in the discharge space of the pre-ignition gap.

The free ends 14 of the electrodes 11 according to the invention, or the coatings 13 provided thereon, exhibit very little, if any, sputtering. Since the electrodes 11 of the invention comprise metals in the region of sparking, rather than oxides, nitrides or like compounds for which expensive and time-consuming operations are required in order to provide these on the electrodes, the pre-ignition gaps of the invention are extraordinarily inexpensive to mass produce. Furthermore, the pre-ignition gaps according to the invention may be produced as separate articles of manufacture in spark plug connectors and then plugged into the spark plugs, or they may be built into the bore provided in the insulation of the spark plug. Also, the sparking voltage of the novel pre-ignition gaps exhibits very little, if any, frequency dependence up to frequencies of at least 150 Hertz.

As mentioned earlier, the pre-ignition gaps in accordance with the invention are adapted for operation at a predetermined sparking voltage between 2 and 16 kV and, in particular, between 4 and 12 kV. It is pointed out here that the sparking voltage of the pre-ignition gap must be at least equal to the sparking voltage of the spark plug but must, however, be less than the minimum voltage which can be delivered by the ignition system. The novel pre-ignition gaps insure that a relatively stable average value of the sparking voltage is maintained for the life of the spark plugs or spark plug connectors.

The pre-ignition gaps according to the invention permit an after-discharge to occur subsequent to sparking. The after-discharge voltage is advantageously no greater than 1 kV. The after-discharge voltage is that voltage existing between the electrodes of the pre-ignition gap after sparking has occurred. This after-discharge voltage permits residual energy to flow from the ignition coil to the spark plug for a period of 0.02 to 1 millisecond after sparking has already occurred. The length of time for which sparking occurs at the spark plug is then correspondingly increased. However, in order to insure that no undesired after-sparks come into existance during this after-discharge between the electrodes of the spark plug, the after-discharge voltage of the pre-ignition gap is advantageously maintained at a value no greater than 1 kV. The after-discharge is accompanied by a further heating up of the spark channel of the spark plug which is favorable since it assures that ignition will occur readily.

The sparking voltage of the pre-ignition gap, as well as the after-discharge voltage, may be preset or predetermined. This is accomplished by selecting an appropriate combination of the pressure of the gas in the discharge space and the spacing between the free ends of the electrodes or the coatings provided thereon.

As pointed out earlier, the atmosphere in the discharge space of a pre-ignition gap according to the invention is of high purity since the novel electrodes form stable compounds with the impurities contained in the gas accommodated within the discharge space. For the purpose of comparison, it is noted here that the discharge space in known pre-ignition gaps is formed by a synthetic resin housing and that the discharge space is filled with air or other gases which are not of sufficient purity. As already mentioned, the known electrodes for pre-ignition gaps are not capable of combining with the impurities contained in the gas accommodated within the discharge space, at least not to the great extent of the electrodes of the invention.

Ignition systems, and particularly coil ignition systems, having pre-ignition gaps in accordance with the invention connected to their high-tension leads fulfill all economic and operational requirements imposed upon them.

It will be understood that each of the elements described above, or two or more together, may also find a useful application in other types of construction and uses differing from the type described above.

While the invention has been illustrated and described as embodied in a pre-ignition gap, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. In an ignition system for combustion engines, particularly a coil ignition system, a pre-ignition gap for use at an average sparking voltage between about 2 and 16 kilovolts comprising means defining a closed compartment; a pair of electrodes extending into said compartment and having spaced free ends therein with the spacing between said free ends being in the range of about 0.5 to 5 millimeters, said electrodes in the region of sparking, being composed of or having a surface portion composed of at least one substance selected from the group consisting of titanium, zirconium, hafnium, columbium and tantalum; and a body of gas accommodated in said compartment at a pressure between about 0.8 and 10 bars and surrounding said free ends, said gas including at least one noble gas and containing at most about 10 percent by weight of hydrogen, at most about 0.1 percent by weight of oxygen and at most about 0.1 percent by weight of water.

2. In an ignition system as defined in claim 1, wherein said pre-ignition gap is constructed for use at an average sparking voltage between about 4 and 12 kilovolts.

3. In an ignition system as defined in claim 1, wherein said spacing is in the range of about 0.8 to 2.5 millimeters.

4. In an ignition system as defined in claim 1, wherein said pressure is between about 2 and 7 bars.

5. In an ignition system as defined in claim 1, wherein said gas comprises argon.

6. In an ignition system as defined in claim 1, wherein said gas comprises neon.

7. In an ignition system as defined in claim 1, wherein said gas comprises krypton.

8. In an ignition system as defined in claim 1, wherein said compartment has a diameter which is at least twice as large as the spacing between said free ends.

9. In an ignition system as defined in claim 8, wherein said diameter is between about three and six times as large as the spacing between said free ends.

10. In an ignition system as defined in claim 1, wherein said substance is provided on at least one of said electrodes in the form of a coating.

11. In an ignition system as defined in claim 1, wherein said surface portion is composed essentially of zirconium.

12. In an ignition system as defined in claim 1, wherein said surface portion is composed essentially of hafnium.

* * * * *